US006361431B1

(12) United States Patent
Kawano

(10) Patent No.: US 6,361,431 B1
(45) Date of Patent: Mar. 26, 2002

(54) METHOD FOR VENTILATING AN INTERNAL SPACE BY ROTATING AIR FLOW

(76) Inventor: Michihiko Kawano, 1-6-203, Tani 1-chome, Chuo-ku, Fukuoka-shi, Fukuoka 810-0031 (JP)

( * ) Notice: Subject to any disclaimer, the term of this patent is extended or adjusted under 35 U.S.C. 154(b) by 0 days.

(21) Appl. No.: 09/674,646

(22) PCT Filed: Mar. 3, 2000

(86) PCT No.: PCT/JP00/01257

§ 371 Date: Nov. 2, 2000

§ 102(e) Date: Nov. 2, 2000

(87) PCT Pub. No.: WO00/53980

PCT Pub. Date: Sep. 14, 2000

(30) Foreign Application Priority Data

Mar. 8, 1999 (JP) ..... 11-060275

(51) Int. Cl.[7] ..... F24F 7/007

(52) U.S. Cl. ..... 454/228; 454/189; 454/230; 454/231

(58) Field of Search ..... 454/189, 228, 454/230, 231, 233

(56) References Cited

U.S. PATENT DOCUMENTS

| | | | | |
|---|---|---|---|---|
| 4,484,517 A | * | 11/1984 | Amann | |
| 5,096,467 A | * | 3/1992 | Matsui | 454/189 X |
| 5,531,484 A | | 7/1996 | Kawano | |

FOREIGN PATENT DOCUMENTS

| | | | | |
|---|---|---|---|---|
| CN | 95102932.0 | | 10/1999 | |
| JP | 54-28435 A | * | 3/1979 | 454/233 |
| JP | 59-100328 A | * | 6/1984 | 454/230 |
| JP | 61-202035 | | 9/1986 | |
| JP | 61-159722 | | 10/1986 | |
| JP | 62-261842 A | * | 11/1987 | 454/189 |
| JP | 63-169434 A | * | 7/1988 | 454/189 |
| JP | 1-38541 A | * | 2/1989 | 454/189 |
| JP | 1-114644 A | * | 5/1989 | 454/189 |
| JP | 5-180473 | | 7/1993 | |
| JP | 2706222 | | 10/1997 | |
| KR | 0174734 | | 11/1998 | |

OTHER PUBLICATIONS

JSME Mechanical Engineers' Handbook, ISBN4–88898–057–8 C3553, pp. 48–49,"Rotating Flow on a Plane" H.P. Greenspan, The Theory of Rotating Fluids, 1968.

* cited by examiner

*Primary Examiner*—Harold Joyce
(74) *Attorney, Agent, or Firm*—Griffin & Szipl, P.C.

(57) ABSTRACT

A method for ventilating an internal space by rotating air flow comprises a step of blowing out a jet of internal air having a vertically long rectangular cross section and uniform blowout velocity distribution over the cross section horizontally along the side wall of the internal space. The jet of internal air generates a horizontal rotating air flow over the whole internal space to induce a horizontally circulating air flow and a vertically circulating air flow over the whole internal space.

2 Claims, 11 Drawing Sheets

METHOD FOR VENTILATING AN INTERNAL SPACE BY ROTATING AIR FLOW

TECHNICAL FIELD

The present invention relates to the air conditioning of an internal space.

BACKGROUND ART

The air conditioning of an internal space such as a living room, factory, garden house, fermentation room, drying room, cold storage, etc. is carried out for adjusting air temperature, humidity, flow, and clarity to a condition suitable for the purpose and uniformly distributing them throughout the internal space. The adjustment of these four factors of the air to a condition suitable for the purpose at hand can already be substantially achieved thanks to the development of air conditioning apparatuses such as heating and cooling apparatuses, drying and humidifying apparatuses, air cleaning apparatuses, etc. However, uniform distribution of the four air factors throughout an internal space cannot yet be fully achieved because of insufficient development of technologies for making the conditions of the internal space uniform and for air exchange. Therefore, a number of unsolved problems remain in the air conditioning of factories, garden houses, cold storages, etc.

DISCLOSURE OF INVENTION

An object of the present invention is to provide a method for ventilating an internal space to achieve uniform distribution of temperature, humidity, flow, and clarity of the internal air and air exchange between the internal air and external air.

According to the present invention, there is provided a method for ventilating an internal space by rotating air flow comprising a step of blowing out a jet of internal air having a vertically long rectangular cross section and uniform blowout velocity distribution over the cross section horizontally along the side wall of the internal space to generate a horizontal rotating air flow over the whole internal space, thereby inducing a horizontally circulating air flow and a vertically circulating air flow over the whole internal space.

The present ventilating method by rotating air flow is based on the theory of "Rotating Flow on a Plane" (Greenspan, H. P:The Theory of Rotating Fluids, Cambridge Univ. Press, 1968) published in 1968 by H. P. Greenspan, who established the theory based on the analysis of the airflow of tropical storms.

The theory of "Rotating Flow on a Plane" will be explained based on FIG. 1. In the horizontally rotating air flow of a tropical storm, a pressure field directed toward the center of the rotation is generated because of the generation of vacuum pressure accompanying the rotation of the air. Centrifugal force generated by the rotation of the air and the radial force directed toward the center of the rotation generated by the pressure field are in balance.

Close to the ground surface, the centrifugal force decreases because the viscosity of the air decreases the circumferential velocity of the air flow. Close to the ground surface therefore, a radial air flow directed toward the center of the rotation is induced by the pressure field directed toward the center of the rotation. The radial air flow changes directions at a point close to the center of the rotating air flow to form a secondary flow directed vertically upward.

The present ventilating method by rotating air flow effectively achieves uniform distribution of air temperature, humidity, flow, clarity in the internal space by utilizing a horizontally rotating air flow over the whole internal space and the vertically upward secondary air flow induced by the horizontally rotating air flow.

In the present ventilating method by rotating air flow, a jet of internal air having a vertically long rectangular cross section and uniform blowout velocity distribution over the cross section is blown out horizontally along the side wall of the internal space. Energy loss of the jet of internal air having a uniform blowout velocity distribution over the cross section and low blowout velocity caused by the entrainment of ambient air is small. Therefore, the jet of internal air circulates in the internal space along the side wall of the space with its vertically long rectangular cross section maintained. The horizontally rotating flow of the jet of internal air is transmitted to the air of the central portion of the internal space and the air of the upper and the lower portion of the internal space through friction force to induce a horizontally rotating air flow over the whole internal space. Close to the floor surface, a radial air flow directed toward the center of the internal space is induced by the imbalance between the centrifugal force and the force directed toward the center of the internal space due to the pressure field.

The radial air flow forms a secondary flow directed vertically upward at the center of the internal space. The vertically rising secondary flow reaches the center of the ceiling of the internal space to flow radially toward the side walls of the internal space. The secondary flow reaching the upper end of the side walls flows down along the side walls. Thus, a horizontally circulating flow and a vertically circulating flow of internal air are induced over the whole internal space. The horizontally circulating flow and the vertically circulating flow agitate the internal air to make the distribution of temperature, humidity, flow and clarity of the internal air uniform.

According to the present invention, there is provided a method for ventilating an internal space by rotating air flow comprising a step of blowing out a jet of internal air having a vertically long rectangular cross section and uniform blowout velocity distribution over the cross section horizontally along the side wall of the internal space to generate a horizontal rotating air flow over the whole internal space, thereby inducing a horizontally circulating air flow and a vertically circulating air flow over the whole internal space, and air exchange between the internal air and external air.

When ventilation windows in the side wall and the ceiling of the internal space are opened, external air entrained by the internal horizontally circulating air flow enters the internal space through the ventilation windows in the side wall. The external air horizontally circulates in the internal space and gradually joins the vertically circulating flow of internal air so that the combined flow leaves the internal space through the ventilation windows in the ceiling of the internal space. Thus, air exchange between the internal air and external air is induced. The horizontally circulating flow and the vertically circulating flow agitate the internal air to make the distribution of temperature, humidity, flow, and clarity of the internal air uniform.

According to a preferred embodiment of the present invention, the jet of internal air is blown out through a blowout elbow provided with guide vanes, wherein one or more guide vanes made of a curved plate and straight plates connected to the curved plate are disposed to make the shapes of the sub-channels defined thereby similar to each other based on the following formulas:

$$p_o = h/\{[f/(f-r)]^m - 1\} \quad (1)$$

$$a_n = p_o r[f/(f-r)]^n \quad (2)$$

$$b_n = a_n/f \quad (3)$$

$p_o$: overhang length at the outlet of the elbow h: inlet breadth of the elbow f: enlargement ratio of the elbow (f=W/h)

W: outlet breadth of the elbow m: number of sub-channels ($m \geqq 2$)

$a_n$: outlet breadth of n-th sub-channel ($a_o$ indicates the radius of curvature of the inner side wall and $a_m$ indicates the radius of curvature of the outer side wall)

r: aspect ratio of the sub-channels $b_n$: inlet breadth of n-th sub-channel

The above mentioned blowout elbow is the one taught by Japanese Patent No. 2706222, U.S. Pat. No. 5531484, Chinese Patent No. 95102932.0 and Korean Patent No. 174734 belonging to the applicant of the present invention. A jet of internal air can be blown out through the above mentioned blowout elbow connected to an air blower.

Correlation between travel distance and air jet velocity in static air was measured for three kinds of air blowers: an air blower 'a' consisting solely of an axial fan of 400 mm diameter, an air blower 'b' composed of the air blower 'a' equipped with a rectification grid, and an air blower 'c' composed of the air blower 'b' equipped with a blowout elbow provided with guide vanes in accordance with Japanese Patent No. 2706222, U.S. Pat. No. 5531484, Chinese Patent No. 95102932.0 and Korean Patent No. 174734. Results of the measurements are shown in FIG. 2.

The initial velocity of the air jet by the air blowers 'a' and 'b' was 11 m/s and the initial velocity of the air jet by the air blower 'c' with the enlargement ratio of 3.5 was 11 m/3.5≈3.1 m/s.

As seen from FIG. 2, the rates of velocity reduction of the air jets by the air blowers 'a' and 'b' were large because the initial velocities of the air jets by the air blowers 'a' and 'b' were large and the energy losses caused by air entrainment were large. The rate of velocity reduction of the air jet by the air blower 'a' was especially large because the air jet by the air blower 'a' had a swirling component that promoted entrainment of ambient air. The rate of velocity reduction of the air jet by the air blower 'c' was small because the air jet by the air blower 'c' was slow and rectified, so that the energy loss caused by the entrainment of ambient air was small.

Considering the fact that the mean velocity of the air flow in gardening houses is 0.25 m/s, the travel distances of the air jets before their velocities fell to 0.25 m/s were measured. As seen from FIG. 2, the travel distances of the air jets from the air blowers 'a', 'b' and 'c' were 25 m. The sectional area of the outlet of the air blower 'c' was 3.5 times as large as those of the air blowers 'a' and 'b'. When considering the effective sectional area of the air jet with a velocity of 0.25 m/s at a travel distance of 25 m, the effective sectional area of the air jet from the air blower 'c' with small entrainment of ambient air is thought to have been far more than 3.5 times as large as those of the air jets from the air blowers 'a' and 'b' with large entrainment of ambient air.

It is thought that the driving force inducing the horizontally circulating air flow in the internal space is proportional to the effective sectional area of the air jet at the travel distance. Therefore, the air blower 'c' is thought to be an effective means for embodying the ventilating method by rotating air flow. As described in the preferred embodiments, the effectiveness of the air blower 'c' was confirmed by field tests.

BRIEF DESCRIPTION OF DRAWINGS

In the drawings:

FIGS. 3(*b*) and 3(*c*) are views along the arrows b—b in FIG. 3(*a*).

FIG. 4(*b*) is a view along the arrows b—b in FIG. 4(*a*).

FIG. 7(*b*) is a cross-sectional view of a strawberry gardening house to which the ventilating method by rotating air flow in accordance with a second embodiment of the present invention was applied.

FIG. 9(*b*) is a view along the arrows b—b in FIG. 9(*a*).

FIG. 10(*b*) is a view along the arrows b—b in FIG. 10(*a*).

FIG. 11(*b*) is a perspective view of the T-shaped blowout elbow with enclosure partially cut away.

BEST MODE FOR CARRYING OUT THE INVENTION

A first preferred embodiment of the present invention will be described.

Figure 1:
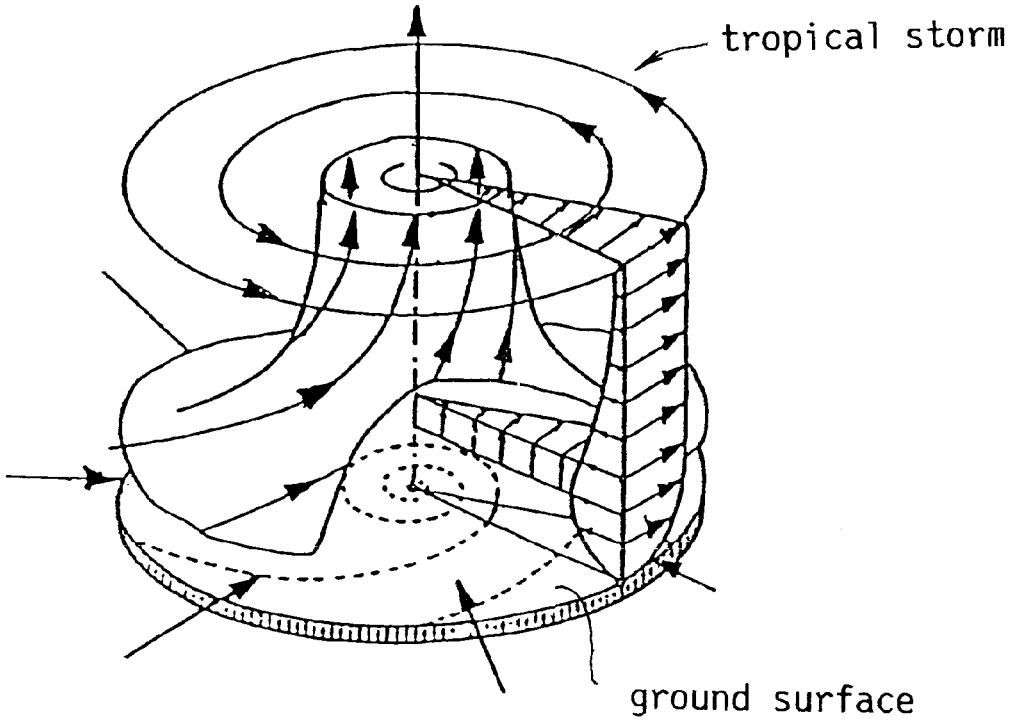
FIG. 1 is an explanatory view illustrating the theory of "Rotational Flow on a Plane".
Figure 2:
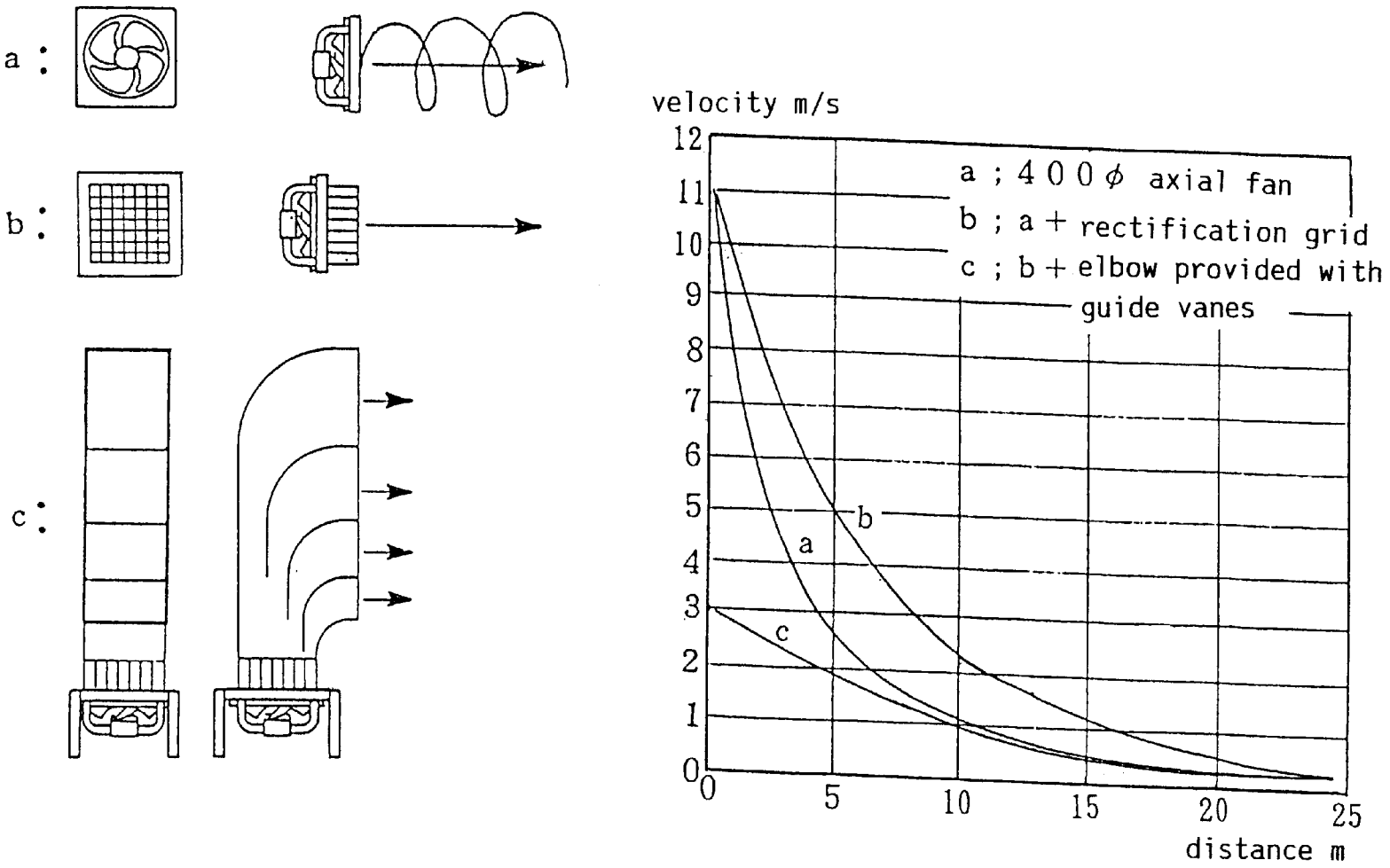
FIG. 2 is a correlation diagram between the travel distances and air jet velocities in static air.
Figure 3:
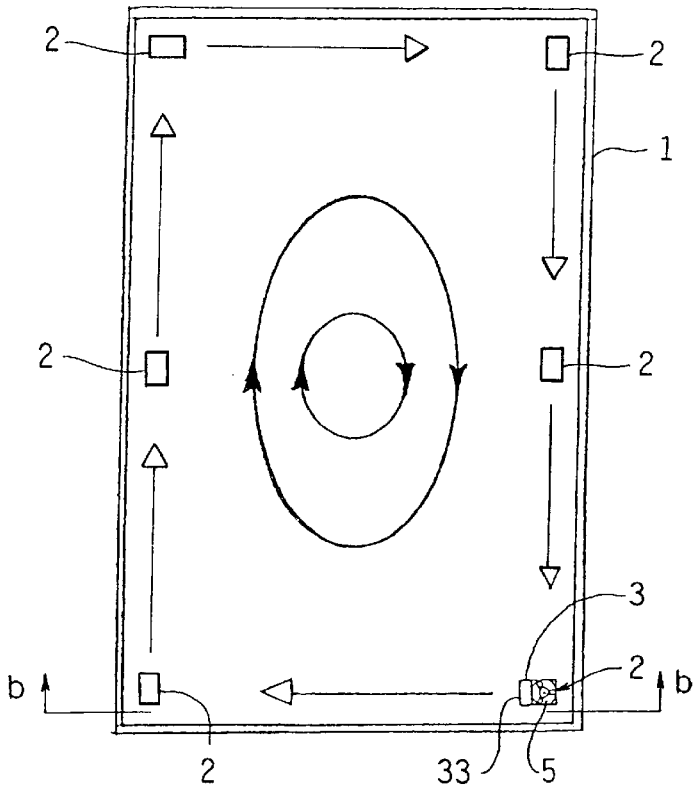
FIG. 3(*a*) is a horizontal sectional view of a gardening house to which the ventilating method by rotating air flow in accordance with a first embodiment of the present invention was applied.
Figure 3:
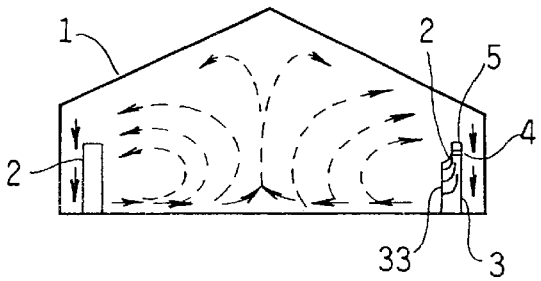
Figure 3:
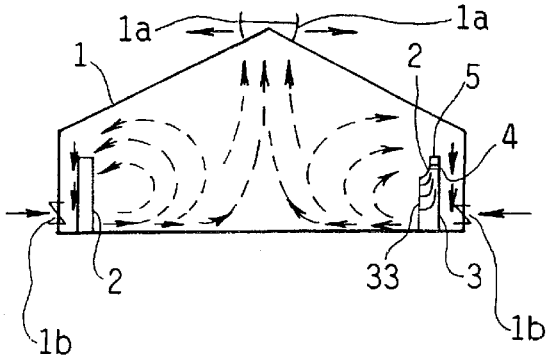
Figure 4:
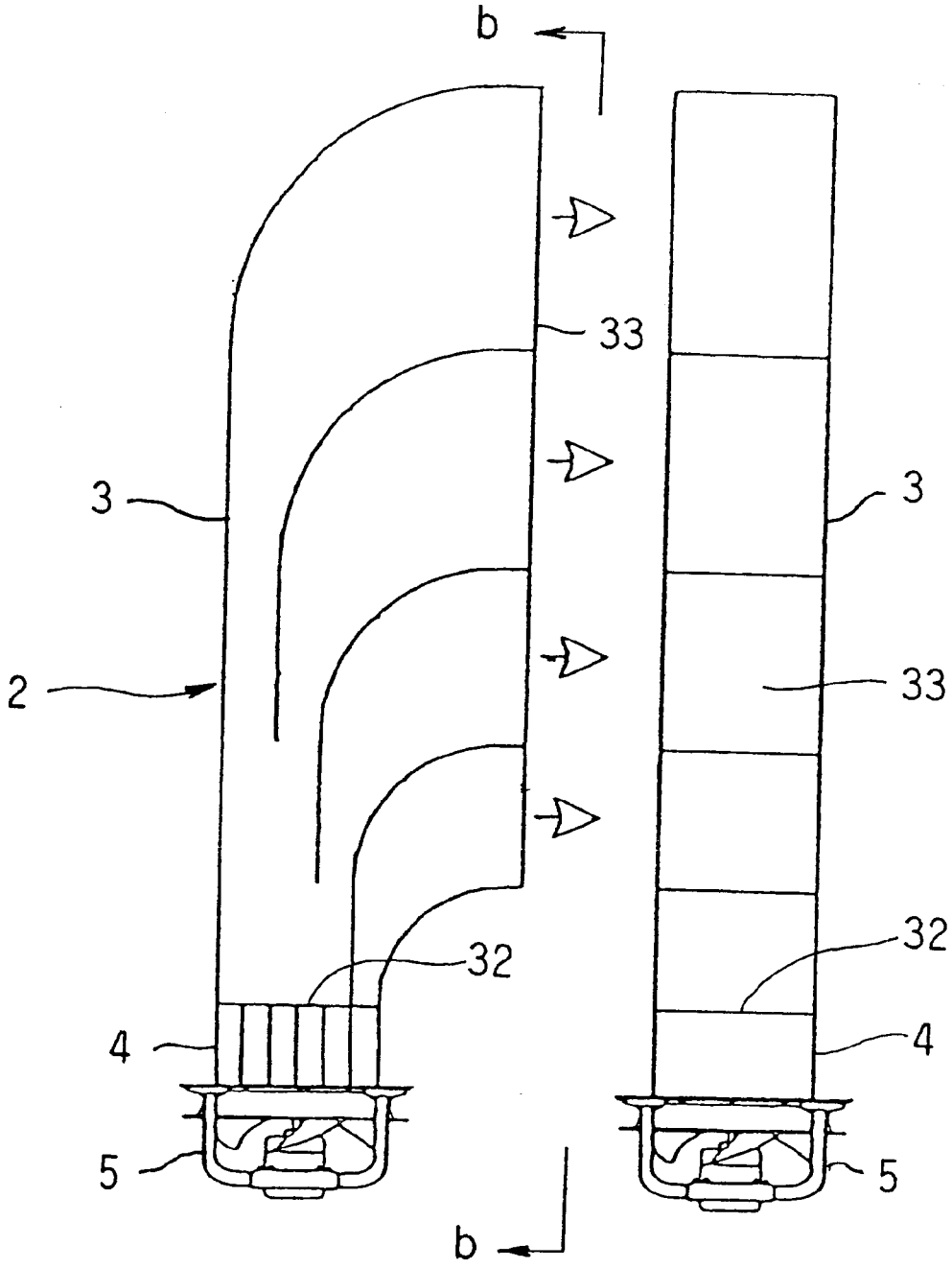
FIG. 4(*a*) is a side sectional view of an air blower used in the ventilating method by rotating air flow in accordance with a first embodiment of the present invention.

As shown in FIGS. 3(*a*) and 3(*b*), six air blowers 2 are installed in a substantially rectangular parallelopiped gardening house 1. One air blower 2 is installed at each corner close to the lower part of the side wall and one at the middle of each longitudinal side close to the lower part of the side wall. The air jets from the six air blowers 2 are directed in the same rotating direction. As shown in FIGS. 3(*a*), 3(*b*), 4(*a*) and 4(*b*), each air blower 2 comprises a blowout elbow provided with guide vanes 3 having a vertically long rectangular outlet 33, a rectification grid 4 connected to the inlet of the blowout elbow provided with guide vanes 3 and an axial fan 5 connected to the rectification grid 4. The blowout elbow provided with guide vanes 3 is the one taught by Japanese Patent No. 2706222, U.S. Pat. No. 5531484, Chinese Patent No. 95102932.0 and Korean Patent No. 174734 which belong to the applicant of the present invention. The blowout elbow provided with guide vanes 3 has a structure wherein one or more guide vanes made of a curved plate and straight plates connected to the curved plate are disposed to make the shapes of the sub-channels defined thereby similar to each other based on the following formulas:

$$p_o = h/\{[f/(f-r)]^n - 1\} \quad ①$$

$$a_n = p_o r[f/(f-r)]^n \quad ②$$

$$b_n = a_n/f \quad ③$$

$p_o$: overhang length at the outlet of the elbow h: inlet breadth of the elbow f: enlargement ratio of the elbow (f=W/h)

W: outlet breadth of the elbow m: number of sub-channels ($m \geqq 2$)

$a_n$: outlet breadth of n-th sub-channel ($a_o$ indicates the radius of curvature of the inner side wall and $a_m$ indicates the radius of curvature of the outer side wall)

r: aspect ratio of the sub-channels $b_n$: inlet breadth of n-th sub-channel

Derivation of formulas ① to ② will be explained based on FIG. 5.

Figure 5:
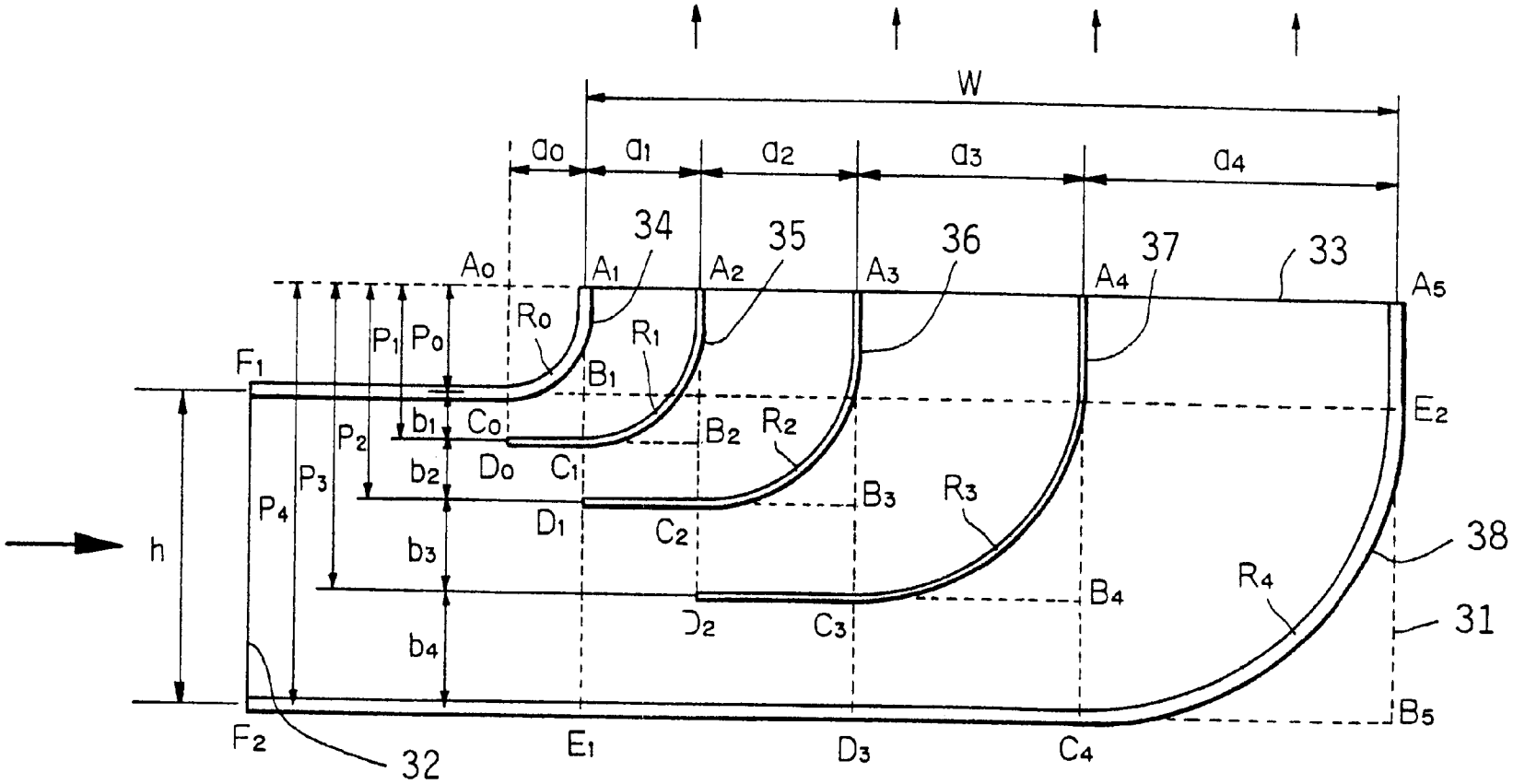
FIG. 5 is a side sectional view of a blowout elbow provided with guide vanes connected to an air blower used in the ventilating method by rotating air flow in accordance with a first embodiment of the present invention.

In FIG. 5, reference numeral 31 indicates a base elbow $B_1E_2B_5E_1$, 32 indicates the inlet of the elbow, 33 indicates the outlet of the elbow, 34 indicates the inner side wall of the elbow, 35, 36 and 37 indicate No. 1 guide vane, No. 2 guide vane and No. 3 guide vane, and 38 indicates the outer side wall of the elbow. Reference letter W indicates the outlet breadth of the elbow, and reference letter h indicates the inlet breadth of the elbow.

The sub-channels defined in the elbow are similar to each other. Thus, the enlargement ratio f of the elbow is expressed as follows:

$$f = W/h = (a_1 + a_2 + a_3 + \ldots)/(b_1 + b_2 + b_3 + \ldots)$$
$$= a_1/b_1 = a_2/b_2 = a_3/b_3 = \ldots$$
$$= a_n/b_n$$

The rectangle lengths $p_n$ of the sub-channels are expressed as follows:

$$p_1 = p_o + b_1,\ p_2 = p_o + b_1 + b_2,\ p_3 = p_o + b_1 + b_2 + b_3,$$
$$\ldots$$
$$p_n = p_o + b_1 + b_2 + b_3 + \ldots + b_n$$

The aspect ratio r of the sub-channels is expressed as follows:

$$r = a_0/p_0 = a_1/p_1 = a_2/p_2 = a_3/p_3 = \ldots$$
$$= a_n/p_n$$

From the above equations, the formulas ① to ③ are derived for obtaining the overhang length $p_o$ at the outlet of the elbow, the outlet breadth $a_n$ of n-th sub-channel, and the inlet breadth $b_n$ of n-th sub-channel based on given values of the inlet breadth h, the outlet breadth W, the number of sub-channels m and the aspect ratio r of the sub-channels.

Configurations of the guide vanes 35 to 37, the inner side wall 34 of the elbow and the outer side wall 38 of the elbow can be determined based on the formulas ① to ③ as follows.

Based on the overhang length $p_o$ at the outlet of the elbow, the outlet breadth $a_n$ of n-th sub-channel, and the inlet breadth $b_n$ of n-th sub-channel, which are obtained from the formulas ① to ③, rectangles $A_oA_1B_1C_o$, $A_1A_2B_2C_1$, $A_2A_3B_3C_2$, $A_3A_4B_4C_3$ and $A_4A_5B_5C_4$ are determined, as shown in FIG. 5. Circular arcs $R_o$, $R_1$, $R_2$, $R_3$ and $R_4$ which respectively touch internally the above rectangles are determined. Circular arcs are determined as follows. $R_o=a_o$, $R_1=a_1$, $R_2=a_2$, $R_3=a_3$ and $R_4=a_4$.

The line $B_2C_1$ is extended by a length equal to that of the line $B_1C_o$ so as to determine a line $C_1D_o$. The line $B_3C_2$ is extended by a length equal to that of the line $B_2C_1$ so as to determine a line $C_2D_1$. The line $B_4C_3$ is extended by a length equal to that of the line $B_3C_2$ so as to determine a line $C_3D_2$. The line $B_1C_o$ is extended by an appropriate length so as to determine a line $C_oF_1$. The line $B_5E_1$ is extended by a length equal to that of the line $B_1F_1$ so as to determine a line $E_1F_2$.

Thus, No. 1 guide vane 35 ($D_oC_1A_2$), No. 2 guide vane 36 ($D_1C_2A_3$), No. 3 guide vane 37 ($D_2C_3A_4$), inner side wall 34 ($F_1C_oA_1$) and outer side wall 38 ($F_2C_4A_5$) are determined. As a result, there is obtained a blowout elbow provided with guide vanes which is divided by No. 1 guide vane 35 ($D_oC_1A_2$), No. 2 guide vane 36 ($D_1C_2A_3$) and No. 3 guide vane 37 ($D_2C_3A_4$) into sub-channels $C_oA_1A_2D_o$, $C_1A_2A_3D_1$, $C_2A_3A4D_2$ and $C_3A_4A_5D_3$ that are similar to each other.

An expansion elbow is obtained when the enlargement ratio f is f>1, a normal elbow is obtained when the enlargement ratio f is f=1 and a reduction elbow is obtained when the enlargement ratio f is f<1. Usually, an expansion elbow or a normal elbow is used as a blowout elbow.

In a bent duct such as an elbow, flow of fluid becomes a free vortex flow. In a free vortex flow, RV=constant (R: radius of flow, V: flow velocity). When an elbow is divided into a plurality of sub-channels, the flow velocity in the inner sub-channel is liable to become larger than that in the outer sub-channel according to the law of free vortex flow. The blowout elbow taught by Japanese Patent No. 2706222, U.S. Pat. No. 5531484, Chinese Patent No. 95102932.0 and Korean Patent No. 174734 is divided into a plurality of similarly shaped sub-channels which decrease in size from the sub-channel near the outer side wall of the elbow toward the sub-channel near the inner side wall of the elbow. Thus, the flow resistance in the sub-channels increases from that in the sub-channel near the outer side wall of the elbow toward that in the sub-channel near the inner side wall of the elbow. Thus, in the blowout elbow taught by Japanese Patent No.

2706222, United States Patent No. 5531484, Chinese Patent No. 95102932.0 and Korean Patent No. 174734, the velocity distribution of a free vortex flow and the flow resistance distribution cancel each other to uniformize the velocity distribution of blowout fluid velocity over the whole width of the outlet of the blowout elbow.

As shown in FIGS. 3(*a*) and 3(*b*), the blowout elbow provided with guide vanes 3 is installed with its vertically long rectangular outlet 33 directed horizontally along the side wall of the gardening house 1. The blowout elbow 3 can blow out an air jet with uniform blowout velocity distribution and low velocity.

In the present ventilating method by rotating air flow, the axial fans 5 of the air blowers 2 operate to blow out jets of internal air with a blowout velocity of 2 to 3 m/s through the outlets 33 of the blowout elbows 3 horizontally along the side wall of the gardening house 1 as indicated by open-headed arrows in FIGS. 3(*a*) and 4(*a*). The jets of internal air blowing out the blowout elbows 3 have uniform blowout velocity distributions over the cross sections and low blowout velocities, so that the entrainment of ambient air are small. Therefore, the jets of internal air circulate in the gardening house 1 along the side wall of the gardening house 1 with their vertically long rectangular cross sections maintained. The horizontally rotating flows of the jets of internal air are transmitted to the air of the central portion of the gardening house 1 and the air of the upper and the lower portions of the gardening house 1 to induce a horizontally rotating air flow over the whole internal space of the gardening house 1 as indicated by solid-headed arrows in FIG. 3(*a*).

Close to the floor surface of the gardening house 1, radial air flows directed toward the center of the gardening house 1 are induced by the imbalance between the centrifugal force generated by the horizontally rotating flow of the internal air and the force directed to the center of the gardening house 1 generated by the pressure field in the rotating air flow. The radial air flows form vertically upward secondary flows at the center of the gardening house 1. The vertically rising secondary flows reach the center of the ceiling of the gardening house 1 to flow radially toward the side walls of the gardening house 1. The secondary flows reaching the upper end of the side walls of the gardening house 1 flow down along the side walls. Thus, horizontally circulating air flows and vertically circulating air flows of internal air are induced over the whole internal space of the gardening house 1 as indicated by solid-headed arrows in FIGS. 3(*a*) and 3(*b*). The horizontally circulating flows and the vertically circulating flows agitate the internal air of the gardening house 1 to make the distribution of temperature, humidity, flow, and clarity of the internal air of the gardening house 1 uniform. As a result, crops produced in the gardening house 1 are enhanced in quality and yield increases. The use of the blowout elbow provided with guide vanes 3 with small flow resistance enables the use of the axial fan 5 with low output as an air blower. Thus, the electric power consumption of the air blower 2 is small, so that the electric power consumption of the gardening house 1 is small.

When skylights 1*a* and side windows 1*b* are opened in the gardening house 1 as shown in FIG. 3(*c*), external air entrained by the horizontally circulating air in the gardening house 1 enters the gardening house 1 through the side windows 1*b*. The external air horizontally circulates in the gardening house 1 and gradually joins the vertically circulating flow of the internal air so that the combined flow leaves the gardening house 1 through the skylights 1*a*. Thus, air exchange between the internal air and the external air is induced. The horizontally circulating flow and the vertically circulating flow agitate the internal air to make the distribution of temperature, humidity, flow, and clarity of the internal air uniform.

According to a ventilating test carried out by the applicant of the present invention in a large gardening house with breadth×length×ridge height×side wall height=36 m×80 m×6 m×3 m (the house was provided with skylights at the top of the ridge and side windows at to top portion of the side wall). An air blower having a blowout elbow provided with guide vanes was installed at each corner close to the lower part of the side wall and at the middle of each longitudinal side close to the lower part of the side wall of the gardening house. In other words, six air blowers in total were installed in the gardening house. The mean daytime air temperature in the lower part of the internal space of the gardening house when the ventilating method by rotating flow in accordance with the present invention was applied to the gardening house with the skylights and the side windows opened was 5° C. lower than that when the ventilating method by rotating flow in accordance with the present invention was not applied to the gardening house with the skylights and the side windows opened. This test result indirectly indicates the fact that air exchange between the internal air and external air occurred in the large gardening house owing to the application of the ventilating method by rotating air flow in accordance with the present invention.

Figure 6C:
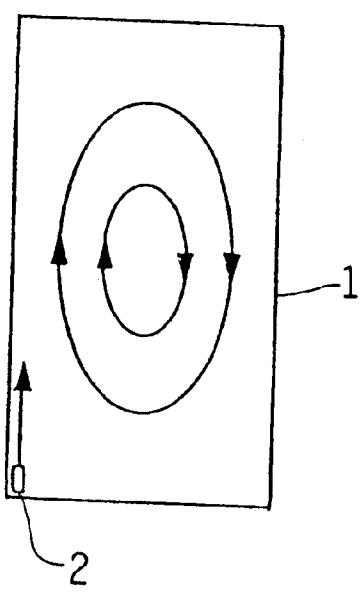
FIGS. 6(*a*), 6(*b*) and 6(*c*) are horizontal sectional views of the gardening house of the first embodiment of the present invention each showing a different number of installed air blowers.
Figure 6B:
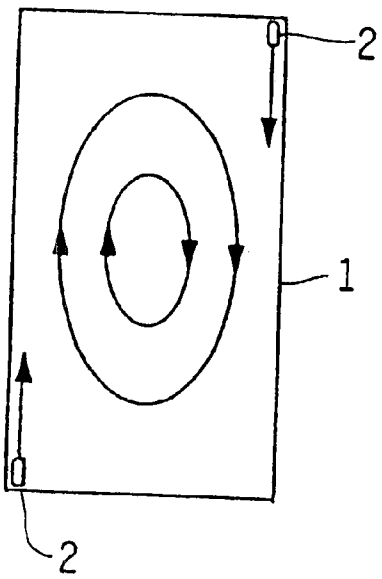
Figure 6A:
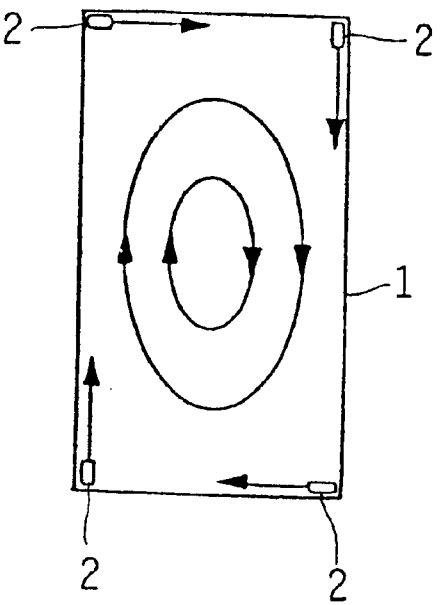

As shown in FIGS. 6(*a*), 6(*b*) and 6(*c*), the number of air blowers 2 can be decreased or increased according to the size and the configuration of the gardening house 1.

A second preferred embodiment of the present invention will be described.

Figure 7:
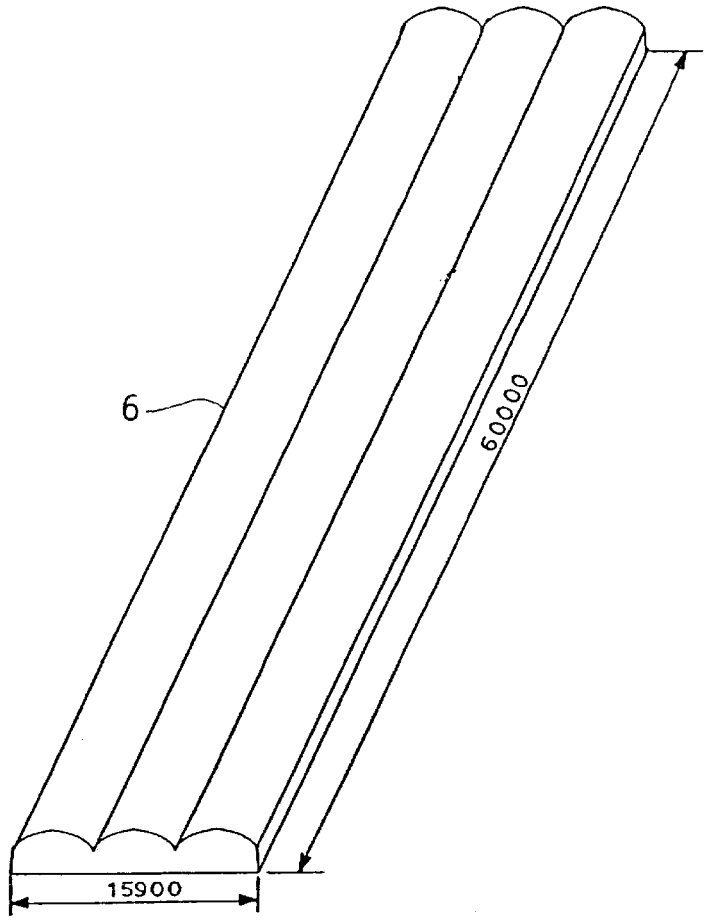
FIG. 7(*a*) is a perspective view of a strawberry gardening house to which the ventilating method by rotating air flow in accordance with a second embodiment of the present invention was applied.
Figure 7:
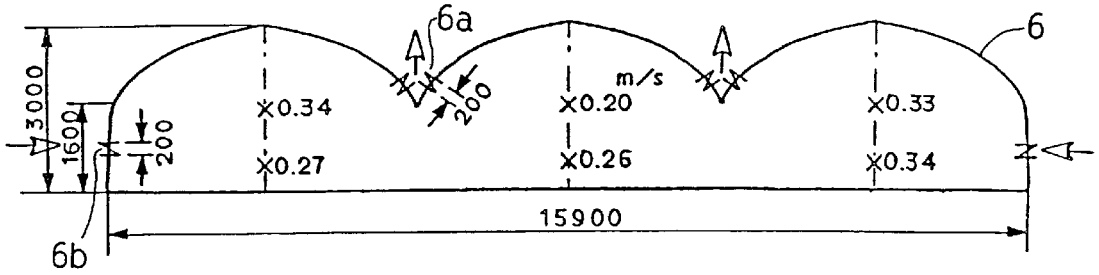

The ventilating method in accordance with the present invention was applied to a strawberry gardening house 6 shown in FIGS. 7(*a*) and 7(*b*) under the following conditions.

- Size of the gardening house: breadth×length×ridge height×side wall height=15.9 m×60 m×3 m×1.6 m
- Skylight, side window: continuous slit of 200 mm width
- Diameter of the axial fan of the air blower: 400 mm
- Size of the outlet of the blowout elbow provided with guide vanes: breadth×height=400 mm×1400 mm
- Number of the air blowers provided with blowout elbow: 6
- Location of the air blowers provided with blowout elbow: at each corner and at the middle of each longitudinal side close to the lower part of the side wall
- Blow out velocity: 3 m/s
- Energy consumption of the air blower: 185W/blower
- Total energy consumption: 185 W×6=1.1KW
- Very uniform air circulation was obtained by the application of the ventilating method in accordance with the present invention under the above conditions. The mean velocity of the horizontally circulating air flow in the gardening house 6 was 0.25 m/s. It is worth noting that very little energy consumption, i.e. only 1.1 KW, was required to generate a horizontally circulating air flow of 0.25 m/s in the gardening house 6 with 1000 $m^2$ class floor area.

In the gardening house 6, the skylights 6*a* and the side windows 6*b* were closed at night and opened from 7 a.m. to 5 p.m. During the period between November to April of the next year, the season for harvesting greenhouse strawberries, dew condensed in the gardening house 6 shortly before the skylights 6*a* and the side windows 6*b* were opened at 7 a.m.

Figure 8:
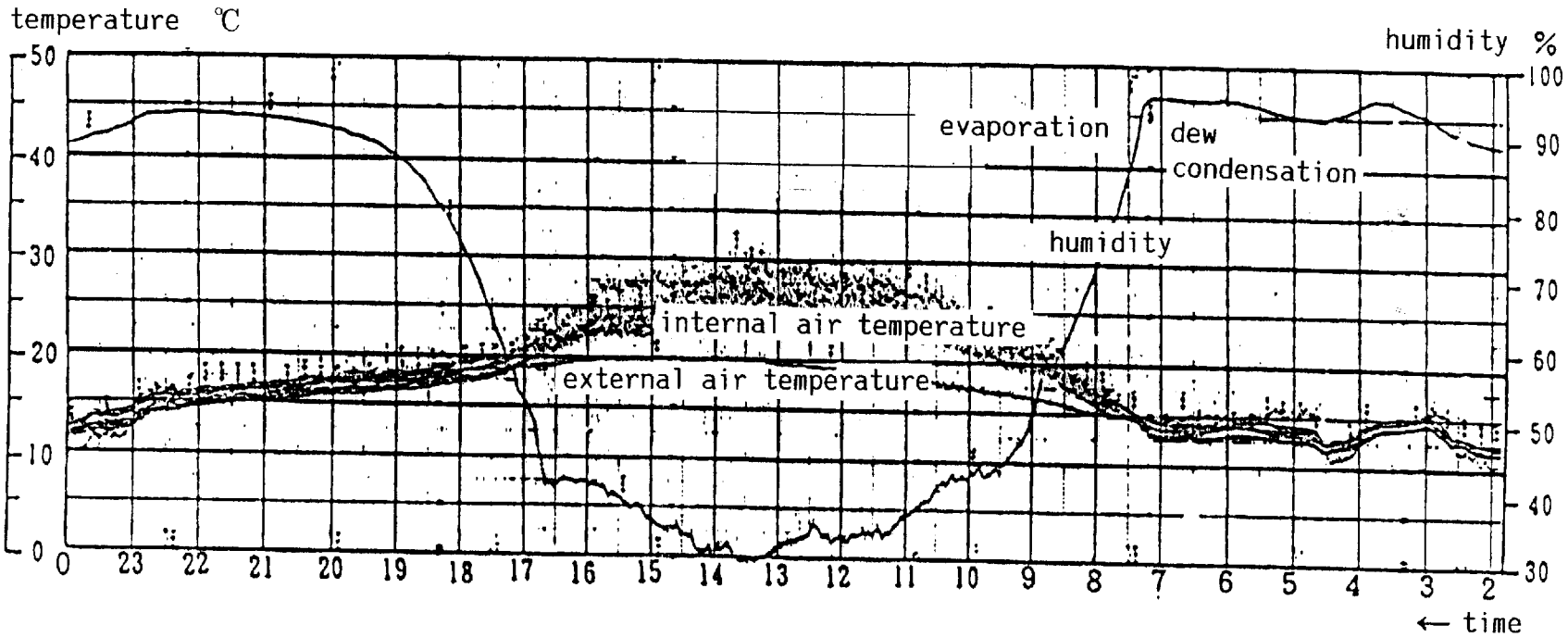
FIG. 8 is a time chart of relative humidity and temperature in a strawberry gardening house to which the ventilating method by rotating air flow in accordance with a second embodiment of the present invention was applied.

The dew evaporated away by about 10 a.m. owing to the temperature rise caused by sunlight and natural air exchange through the opened skylights 6*a* and the side windows 6*b*. In the gardening house 6, the ventilating method by rotating air flow in accordance with the present invention was initiated simultaneously with the opening of the skylights 6*a* and the side windows 6*b* at 7 a.m. As shown in FIG. 8, relative humidity in the gardening house 6 began to drop rapidly 15 minutes after the start of the axial fans of the air blowers equipped with the blowout elbows. At 30 minutes after the start of the axial fans, the relative humidity had dropped to 85% and the dew in the gardening house 6 had dissipated. The air exchanging action of the ventilating method by rotating air flow was indirectly confirmed by the fact that the time necessary for the dissipation of dew under the application of the ventilating method by rotating air flow was 2.5 hours shorter than that under natural air exchange.

By the application of the ventilating method by rotating air flow, the time necessary for the dissipation of dew was shortened, the activity of pollination bees was enhanced, and fruit bearing was promoted. Temperature fall in the gardening house due to air exchange slowed strawberry aging and enhanced the sweetness of the strawberries in proportion. The uniform breeze in the gardening house promoted photosynthesis to enhance strawberry yield. The uniformalization of the temperature in the gardening house uniformalized the growth of the strawberries.

A third preferred embodiment of the present invention will be described.

Figure 9:
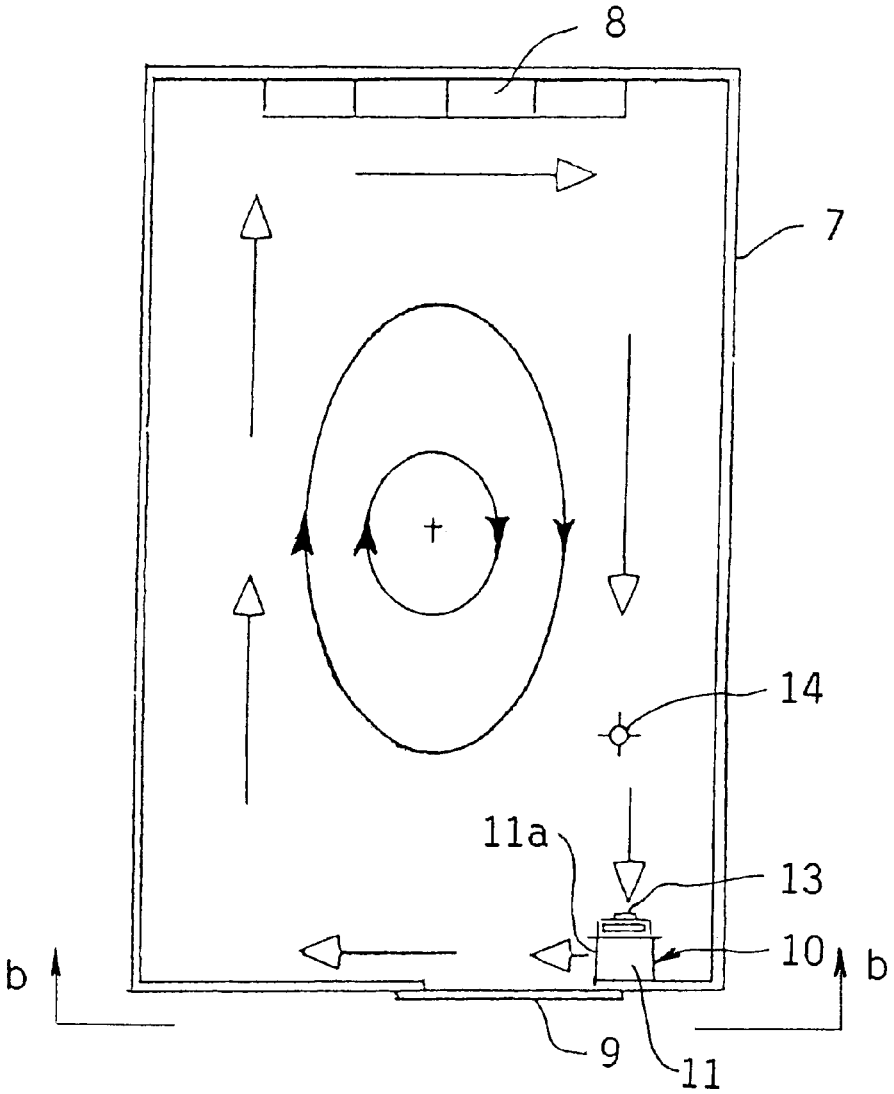
FIG. 9(*a*) is a horizontal sectional view of a cold storage to which the ventilating method by rotating air flow in accordance with a third embodiment of the present invention was applied.
Figure 9:
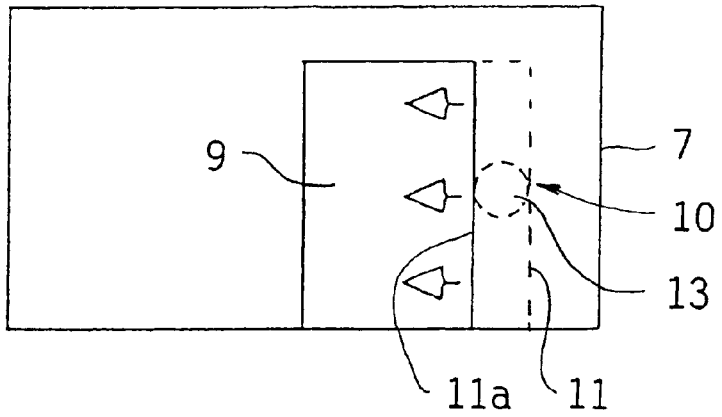
Figure 11:
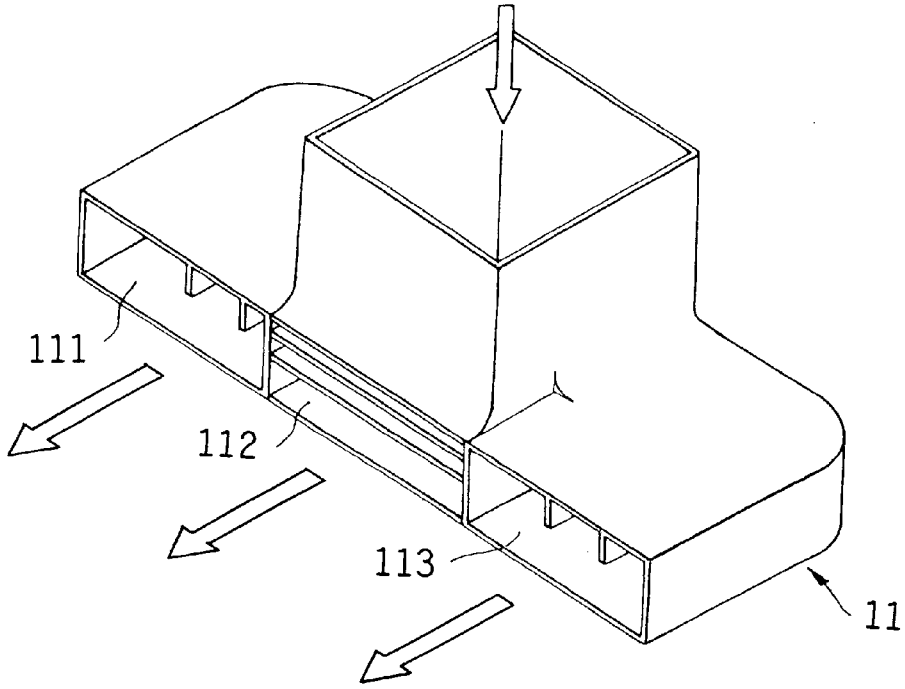
FIG. 11(*a*) is a perspective outside view of a T-shaped blowout elbow provided with guide vanes used in the ventilating method by rotating air flow in accordance with a third embodiment of the present invention.
Figure 11:
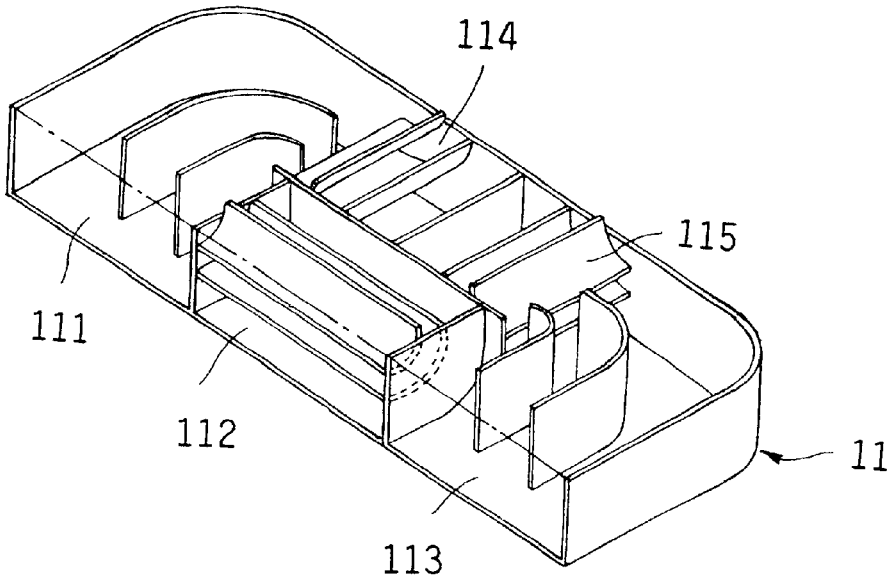

As shown in FIGS. 9(*a*) and 9(*b*), a cold air outlet 8 is installed at the most inner part of a rectangular parallelopiped cold storage 7. An air blower 10 is installed at the entrance 9 of the cold storage 7. As shown in FIGS. 9(*a*), 9(*b*), 10(*a*) and 10(*b*), the air blower 10 comprises a T-shaped blowout elbow provided with guide vanes 11, a rectification grid 12 connected to the inlet of the blowout elbow 11, and an axial fan 13 connected to the rectification grid 12. The T-shaped blowout elbow provided with guide vanes 11 is the one taught by Japanese Patent No. 2706222, U.S. Pat. No. 5531484, Chinese Patent No. 95102932.0 and Korean Patent No. 174734 which belong to the applicant of the present invention. As shown in FIGS. 11(*a*) and 11(*b*), the T-shaped blowout elbow provided with guide vanes 11 comprises five blowout elbows provided with guide vanes 111, 112, 113, 114 and 115 which are connected in tandem and in parallel to each other. Each blowout elbow forming the T-shaped blowout elbow 11 has a configuration determined by the same formulas as the blowout elbow 3 in the first embodiment. The T-shaped blowout elbow 11 is suitable for use in a space with severe limitation of vertical clearance, such as a cold storage.

As shown in FIGS. 9(*a*) and 9(*b*), the T-shaped blowout elbow 11 is installed with its vertically long rectangular outlet 11*a* directed horizontally along the side wall of the cold storage 7. The T-shaped blowout elbow 11 can blow out an air jet with uniform blowout velocity distribution.

In the cold storage 7, the blowout of the cold air is stopped for 20 to 30 minutes during the defrosting cycle to cause a temperature rise of the air in the upper portion of the storage. The temperature rise of the air in the upper portion of the storage causes deterioration of the products stored in the upper portion of the storage. The ventilating method by rotating air flow in accordance with the present invention is applied to the cold storage during the defrosting cycle.

Figure 10:
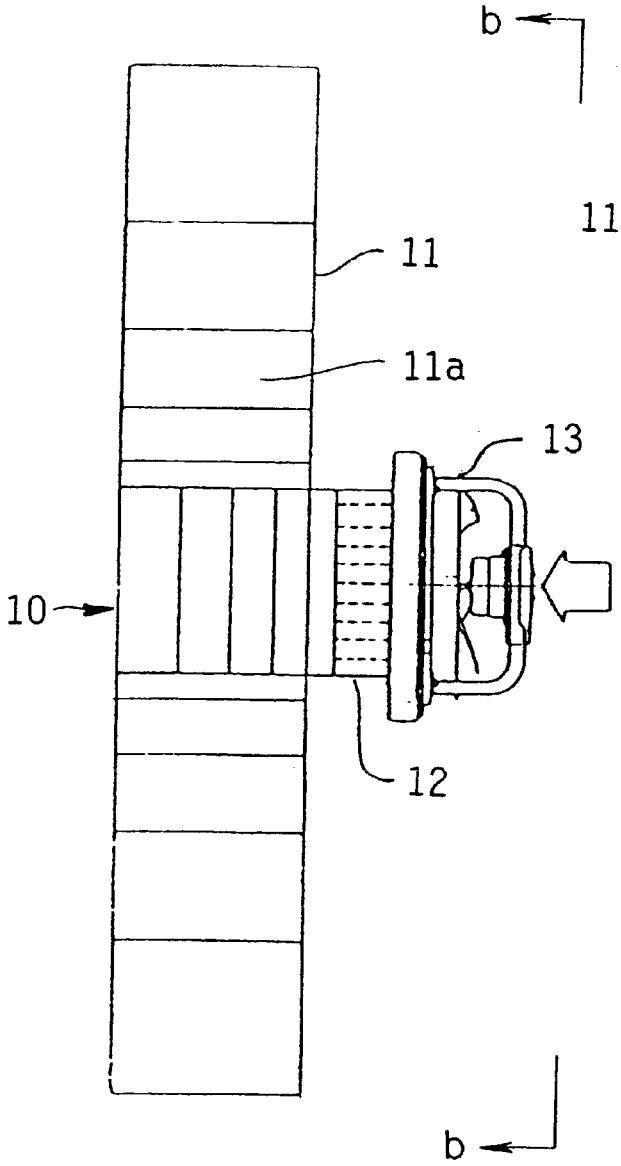
FIG. 10(*a*) is a front view of the outlet of an air blower used in the ventilating method by rotating air flow in accordance with a third embodiment of the present invention.
Figure 10:
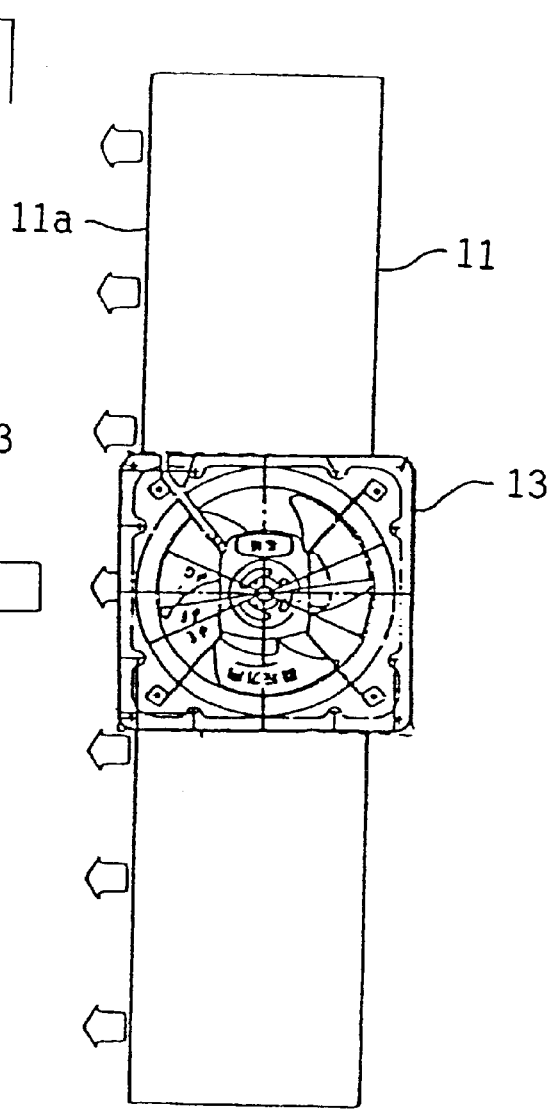

The axial air blower 13 of the air blower 10 operates to blow out jet of internal air at a blowout velocity of 2 to 3 m/s through the outlets Ha of the blowout elbow provided with guide vanes 11 horizontally along the side wall of the cole storage 7 as indicated by open-headed arrows in FIGS. 9(*a*) and 9(*b*) and by open arrows in FIG. 10(*b*). The jet of internal air blowing out the blowout elbow 11 has uniform blowout velocity distribution and low blowout velocity, so that the energy loss due to entrainment of ambient air is small. Therefore, the jet of internal air circulates in the cold storage 7 along the side wall of the cold storage 7 with its vertically long rectangular cross section maintained. The rotating flow of the jet of internal air along the side wall of the cold storage is transmitted to the air of the central portion of the cold storage and the air of the upper and the lower portions of the cold storage to induce a horizontally rotating air flow over the whole internal space of the cold storage as indicated by solid-headed arrows in FIG. 9(*a*).

Close to the floor surface of the cold storage 7, radial air flows directed toward the center of the cold storage are induced by the imbalance between the centrifugal force generated by the horizontally rotating flow of the internal air and the force directed toward the center of the cold storage generated by the pressure field in the rotating air flow. The radial air flows form vertically upward secondary flows at the center of the cold storage. The vertically rising secondary flows reach the center of the ceiling of the cold storage to flow radially toward the side walls of the cold storage. The secondary flows reaching the upper end of the side walls of the cold storage flow down along the side walls. Thus, horizontally circulating flows and vertically circulating flows of internal air are induced over the whole internal space of the cold storage. The horizontally circulating flows and the vertically circulating flows agitate the internal air of the cold storage to make the distribution of temperature in the cold storage uniform. As a result, the deterioration of products stored in the upper portion of the cold storage during the defrosting cycle is prevented.

The use of the blowout elbow provided with guide vanes 11 with small flow resistance enables the use of the axial fan 13 with low output as an air blower to achieve a large saving of electric power consumption.

The effect of the ventilating method in accordance with the present invention was confirmed by a field-test.

1. Specifications of the cold storage

Breadth: 4,300 mm
Depth: 7,000 mm
Height: 2,400 mm
Volume: 72. 2 $m^3$

2. Specifications of the air blower

An air blower having a T-shaped blowout elbow provided with guide vanes in accordance with Japanese Patent No. 2706222:

Blowout velocity: 1.6 m/s
Width of the outlet: 350 mm
Height of the outlet: 2,000 mm
Diameter of the axial fan: 400 mm
Flow rate: 4,000 $m^3$/hour
Electric power consumption: 180 W 3. Test condition The test was carried out during the defrosting cycle of a cold storage containing stored products .

As shown in FIG. 9(*a*), temperature sensors were connected to a supporting pole 14 erected in the cold storage 7 to measure the air temperatures at the top portion and the floor portion of the internal space of the cold storage.

External air temperature: 16° C.

Air temperature in the cold storage at the start of the defrosting cycle: −24° C. uniformly distributed Duration of defrosting cycle: 25 minutes 4. Test result Air temperature at the end of the defrosting cycle

| | |
|---|---|
| Without air blow: | top portion (+8° C.)<br>floor portion (−20° C.) |
| With air blow: | (−11° C. uniformly distributed) |

As seen from the test result, there was a large difference between the air temperatures of the top portion and the floor portion of the cold storage at the end of the defrosting cycle when no air was blown from the air blower, while the temperature distribution of the air in the cold storage at the end of the defrosting cycle was made uniform by the air blow from the air blower with low output of only 180W when air was blown out from the air blower.

It was confirmed that the ventilating method by rotating air flow in accordance with the present invention can effectively make the temperature distribution of the air in a cold storage uniform with very small electric power consumption.

INDUSTRIAL APPLICABILITY

The ventilating method by rotating air flow in accordance with the present invention is effective for improving comfort, increasing product yield, controlling product quality, energy saving, etc. in not only gardening houses and cold storages but also living rooms, factories, air conditioned rooms, etc.

What is claimed is:

1. A method for ventilating an internal space by rotating air flow, the method comprising:

blowing out a jet of internal air within an internal space, the jet having a vertically long rectangular cross section and uniform blowout velocity distribution over the cross section and directed horizontally along a side wall which borders the internal space, wherein the jet is blown out through a blowout elbow provided with at least one guide vane, wherein the at least one guide vane comprises a curved plate and a straight plate connected to the curved plate, wherein the curved plate and the straight plate are disposed to make sub-channels, wherein the sub-channels are defined in shape based on the following formulas:

$$p_o=h/\{[f/f(f-r)]^m-1\} \quad (1)$$

$$a_n=p_o r[f/(f-r)]^n \quad (2)$$

$$b_n=a_n/f \quad (3)$$

wherein $p_o$=overhang length at an outlet of the elbow, h=inlet breadth of the elbow, f=enlargement ratio of the elbow (f=W/h), W=outlet breadth of the elbow, m=number of sub-channels (m≧2), $a_n$=outlet breadth of n-th sub-channel ($a_o$ indicates the radius of curvature of an inner side wall of the elbow and $a_m$ indicates the radius of curvature of an outer side wall of the elbow), r=aspect ratio of the sub-channels, and $b_n$=inlet breadth of n-th sub-channel; and generating a horizontal rotating air flow over the whole internal space as a result of blowing out the jet of internal air, thereby inducing a horizontally circulating air flow and a vertically circulating air flow simultaneously over the whole internal space.

2. A method for ventilating an internal space by rotating air flow, the method comprising:

blowing out a jet of internal air within an internal space, the jet having a vertically long rectangular cross section and uniform blowout velocity distribution over the cross section and directed horizontally along a side wall which borders the internal space, wherein the jet is blown out through a blowout elbow provided with at least one guide vane, wherein the at least one guide vane comprises a curved plate and straight plate connected to the curved plate, wherein the curved plate and the straight plate are disposed to make sub-channels, wherein the sub-channels are defined in shape based on the following formulas:

$$p_o=h/\{[f/f(f-r)]^m-1\} \quad (1)$$

$$a_n=p_o r[f/(f-r)]^n \quad (2)$$

$$b_n=a_n/f \quad (3)$$

wherein $p_o$=overhang length at an outlet of the elbow, h=inlet breadth of the elbow, f=enlargement ratio of the elbow (f=W/h), W=outlet breadth of the elbow, m=number of sub-channels (m≧2), $a_n$=outlet breadth of n-th sub-channel ($a_o$ indicates the radius of curvature of an inner side wall of the elbow and am indicates the radius of curvature of an outer side wall of the elbow), r=aspect ratio of the sub-channels, and $b_n$=inlet breadth of n-th sub-channel;

generating a horizontal rotating air flow over the whole internal space as a result of blowing out the jet of internal air, thereby inducing a horizontally circulating air flow and a vertically circulating air flow simultaneously over the whole internal space; and exchanging air between the internal air and external air as a result of either one of the horizontally circulating and the vertically circulating air flows.

* * * * *